United States Patent [19]

Hersh

[11] Patent Number: 4,835,527

[45] Date of Patent: May 30, 1989

[54] LOOK-UP TABLE

[75] Inventor: Clifford L. Hersh, Berkeley, Calif.

[73] Assignee: Genigraphics Corportion, Clifton, N.J.

[21] Appl. No.: 912,990

[22] Filed: Sep. 29, 1986

[51] Int. Cl.[4] ..... G09G 1/28; G09G 1/14

[52] U.S. Cl. ..... 340/703; 340/750; 340/799

[58] Field of Search ..... 340/701, 702, 703, 750, 340/798, 799

[56] References Cited

U.S. PATENT DOCUMENTS

| | | | |
|---|---|---|---|
| 4,258,361 | 3/1981 | Hydes et al. | 340/790 |
| 4,574,277 | 3/1986 | Krause et al. | 340/703 |
| 4,591,842 | 5/1986 | Clarke, Jr. et al. | 340/703 |
| 4,598,282 | 7/1986 | Pugsley | 340/799 |
| 4,649,380 | 3/1987 | Penna | 340/703 |
| 4,673,929 | 6/1987 | Nelson et al. | 340/703 |
| 4,745,407 | 5/1988 | Costello | 340/799 |
| 4,942,474 | 5/1988 | Knierim | 340/799 |

OTHER PUBLICATIONS

"Engineering Notes CAT 1600 Series", by Digital Graphic Systems, Inc.

*Primary Examiner*—Gerald L. Brigance
*Assistant Examiner*—Mahmoud Fatahiyar
*Attorney, Agent, or Firm*—Limbach, Limbach & Sutton

[57] ABSTRACT

In the present invention, a full look-up table for 32 bits is disclosed. The look-up table is for interfacing the output of the memory frame buffer with a color monitor in a digital, color graphics display apparatus. The look-up table duplicates some of the output lines of the memory frame buffer as the input to the look-up table. The input lines and the duplicated input lines are supplied as address input lines to a first memory bank. The output of the first memory bank at the address selected by the input lines are received by a second memory bank as the address input lines therefor. The output of the second memory bank is supplied yet to the third memory bank as the address input lines thereto. The output of the third memory bank forms the output of the look-up table.

10 Claims, 4 Drawing Sheets

LOOK-UP TABLE

DESCRIPTION

1. Technical Background

The present invention relates to a look-up table and, more particularly, a look-up table for interfacing the output of a frame buffer memory with a color monitor in a digital, color graphics display system.

2. Background Of The Invention

Look-up tables for interfacing the output of a memory frame buffer with a color monitor in a digital, color graphics display system are well-known in the art. Typically, look-up tables are merely buffered memories which control the display of color on the color display apparatus. They are used to alter instantly and dynamically the color, brightness and contrast of the displayed image, while the stored image data in the frame buffer remains unaltered.

In the prior art, a look up table comprising a table of random entries is known. A table of random entries has stored therein every possible combination of inputs mapped to a unique output. Thus, all the input lines are addresses to a memory location and the output is the data stored in that memory location. In a typical application, where the frame buffer memory receives 16 bits of input and has 16 bits of output (or $16\times16$), a look-up table comprised of a memory size $2^{16}\times16$ or 128k RAM bytes is needed. Such a look-up table is adequate for low number of bits from the frame buffer memory. However, where a high number of bits are received from the frame buffer memory, such as 32 bits by 32 bits, a look-up table comprising $2^{32}\times32$ or 16 billion bytes of memory is required. Clearly, such a look-up table would not be cost effective.

In the prior art, there is also known a look-up table for space rotation. Such a table divides inputs into groups and then adds the results together. It is adequate for color space rotation and conversion of RGB to YIQ. Its main shortcomings are that it can perform little else. In particular, this look-up table is unable to affect an entire image from a single input bit.

Further, in the prior art there is known a cross point switch whereby at the junction of a row of signal line is a switch. Thus, the number of switches or data sites is low. It is mainly used with space-rotation to achieve other functions. However, this look-up table by itself is not as versatile as Table of Random Entries or Space Rotation.

SUMMARY OF THE INVENTION

In the present invention, a look-up table for interfacing the output of a memory frame buffer with a color monitor in a digital, color graphics display apparatus is disclosed. The table has means for duplicating some of the outputs of the memory frame buffer. A first memory means receives the output and the duplicated output as addresses therefor. The first memory means generates a first output from the address that is received. A second memory means receives the first output as address therefor and generates a second output from the address received. A third memory means receives the second output as address therefor and generates a third output from the address received and supplies the third output to the color monitor.

DETAILED DESCRIPTION OF THE DRAWINGS

Figure 1:
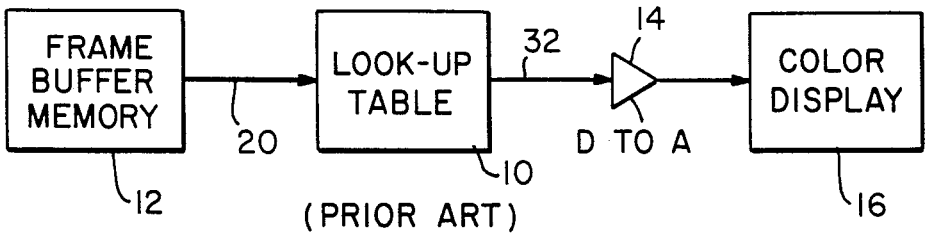
(PRIOR ART) FIG. 1
FIG. 1 is a block diagram of a look-up table used in a digital, color graphics display system.

Referring to FIG. 1, there is shown a look-up table 10. The table 10 receives the output of a frame buffer memory 12 as addresses for the table 10. The data at the address supplied from the frame buffer memory 12 is then outputted from the table 10 to a D-to-A converter 14, which is then passed to a color display 16. The look-up table is used, among others, to alter the color, brightness and contrast of the image being displayed on the color display 16, while the image stored in the frame buffer memory 12 remains unaltered.

Figure 2:
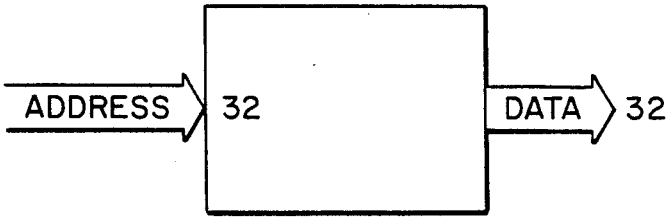
(PRIOR ART) FIG. 2
FIG. 2 is a block diagram of the Table of Random Entries look-up table of the prior art.

Referring to FIG. 2, there is shown a schematic block diagram of a Table of Random Entries Look-Up Table of the prior art. The Table of Random Entries Look-Up Table comprises a single memory bank such as a RAM or ROM adapted to receive input lines and output therefrom the data at the address addressed by the input lines. As previously stated, for a $32\times32$ look-up table, a memory size of 16 billion bytes of storage is required.

Figure 3:
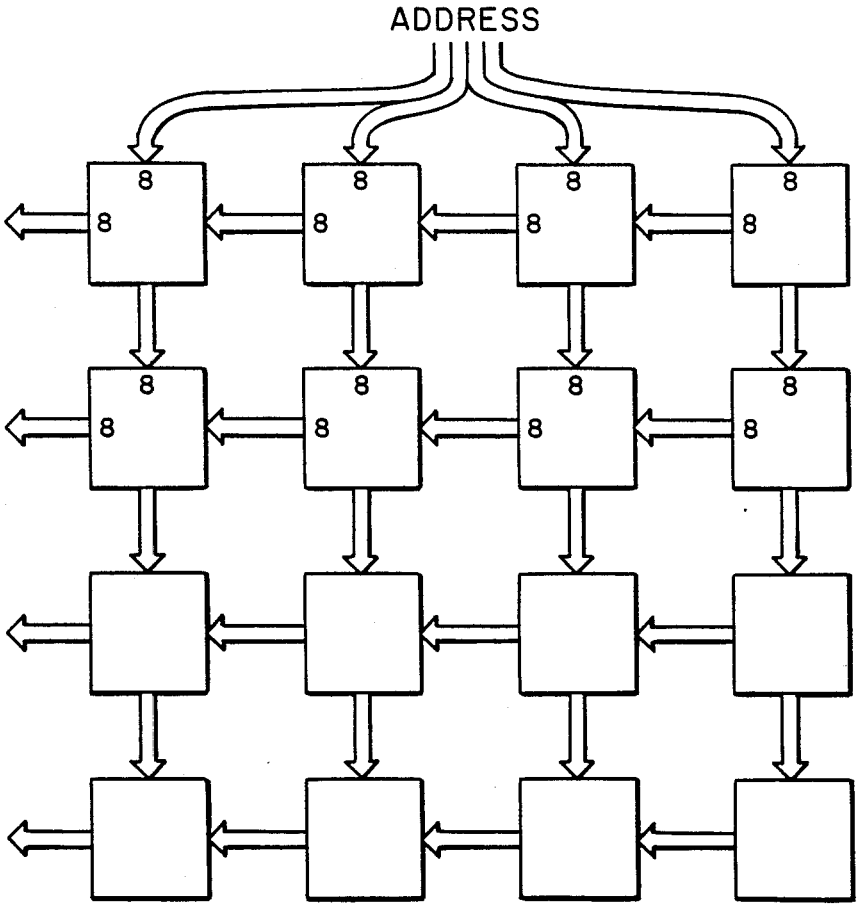
(PRIOR ART) FIG. 3
FIG. 3 is a block diagram of Space Rotation look-up table of the prior art.

Referring to FIG. 3, there is shown a block diagram of a Space Rotation Look-Up Table of the prior art. In this Space Rotation Look-Up Table of the prior art, the address lines are partitioned into a plurality of groups of input lines. Each of the group of input lines is the input to a plurality of memory cells. Each of the group of input lines addresses a memory cell. In the example shown in FIG. 3, if 32 address lines are provided, there are four groups of eight input lines. Each of the group of eight input lines addresses four $8\times8$ memory cell. The outputs of each row of $8\times8$ memory cells are then added together and form four groups of eight output lines resulting in 32 output lines. As can be seen, one of the shortcomings of this look-up table is that one group of input lines cannot affect the entire look-up table.

Figure 4:
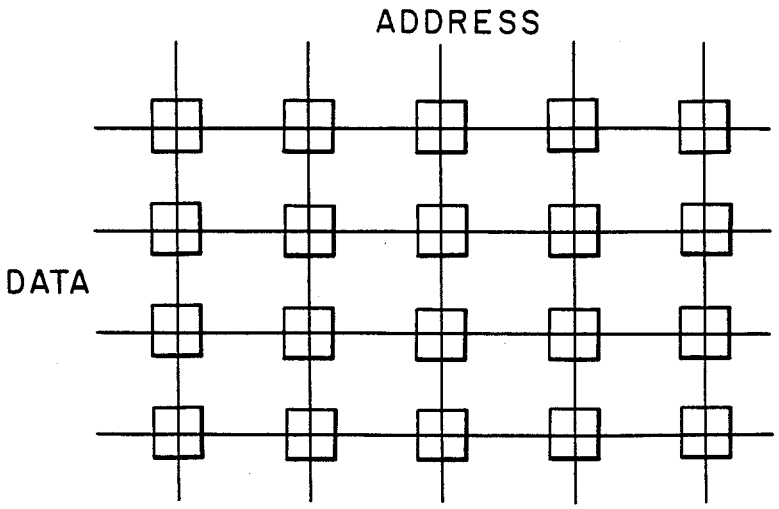
(PRIOR ART) FIG. 4
FIG. 4 is a block diagram of the Cross Point Switch look-up table of the prior art.

Referring to FIG. 4, there is shown a schematic block diagram of a Cross-Point Switch Look-Up Table of the prior art. This look-up table comprises a plurality of input columns lines and a plurality of output row data lines. At the intersection of each column in each row is a switch or a memory cell which can interconnect that row with that column. By appropriate programming it can be seen that a single input line can affect all of the output data lines.

Figure 5:
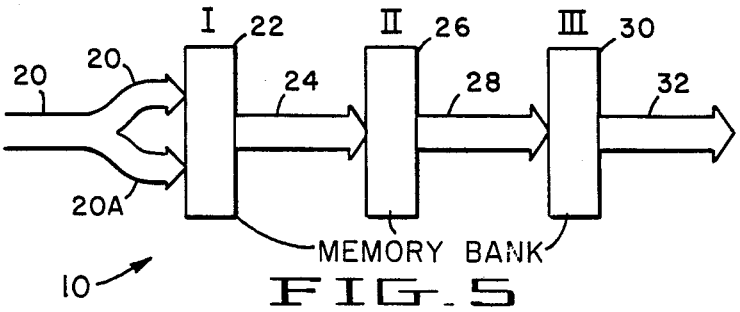
FIG. 5 is a schematic block diagram of the look-up table of the present invention.

Referring to FIG. 5, there is shown in block diagram form the look-up table 10 of the present invention. The look-up table 10 of the present invention receives the output data from the frame buffer memory along the input lines 20 thereto. Some or all of the input lines 20 are duplicated. The input lines 20 and the duplicated input lines 20A are then supplied to a first memory bank 22. The input lines 20 and the duplicated input lines 20A form the addresses for the first memory bank 22. At the address supplied by the input lines 20 and the duplicated input lines 20A, the data is then supplied along the first output lines 24. The data on the first output lines 24 are then supplied to a second memory bank 26 as the address thereto. Data at the address, determined by the first output lines 24, are supplied from the second memory bank 26 along the second output lines 28. The second output lines 28 are then supplied to a third memory bank 30 as the input address therefor. Data at the address supplied by the second output lines 28 are then supplied by the third memory bank 30 and placed on the output lines 32, which form the output of the look-up table 10.

Figure 6:
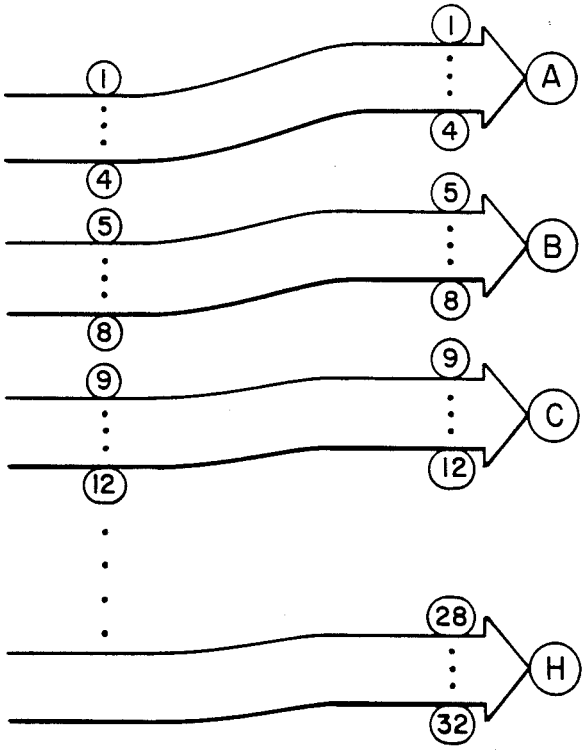
FIG. 6 is a schematic representation of 32 lines of output from the frame buffer memory wherein the lines are partitioned into groups of four lines each.

The look-up table 10 of the present invention is particularly suited to receive 32 lines of data from the frame buffer memory 12 along the input lines 20. In FIG. 6, the 32 lines of input 20 are divided into groups of four lines within each group, designated as A, B, C. . . H.

Figure 7A:
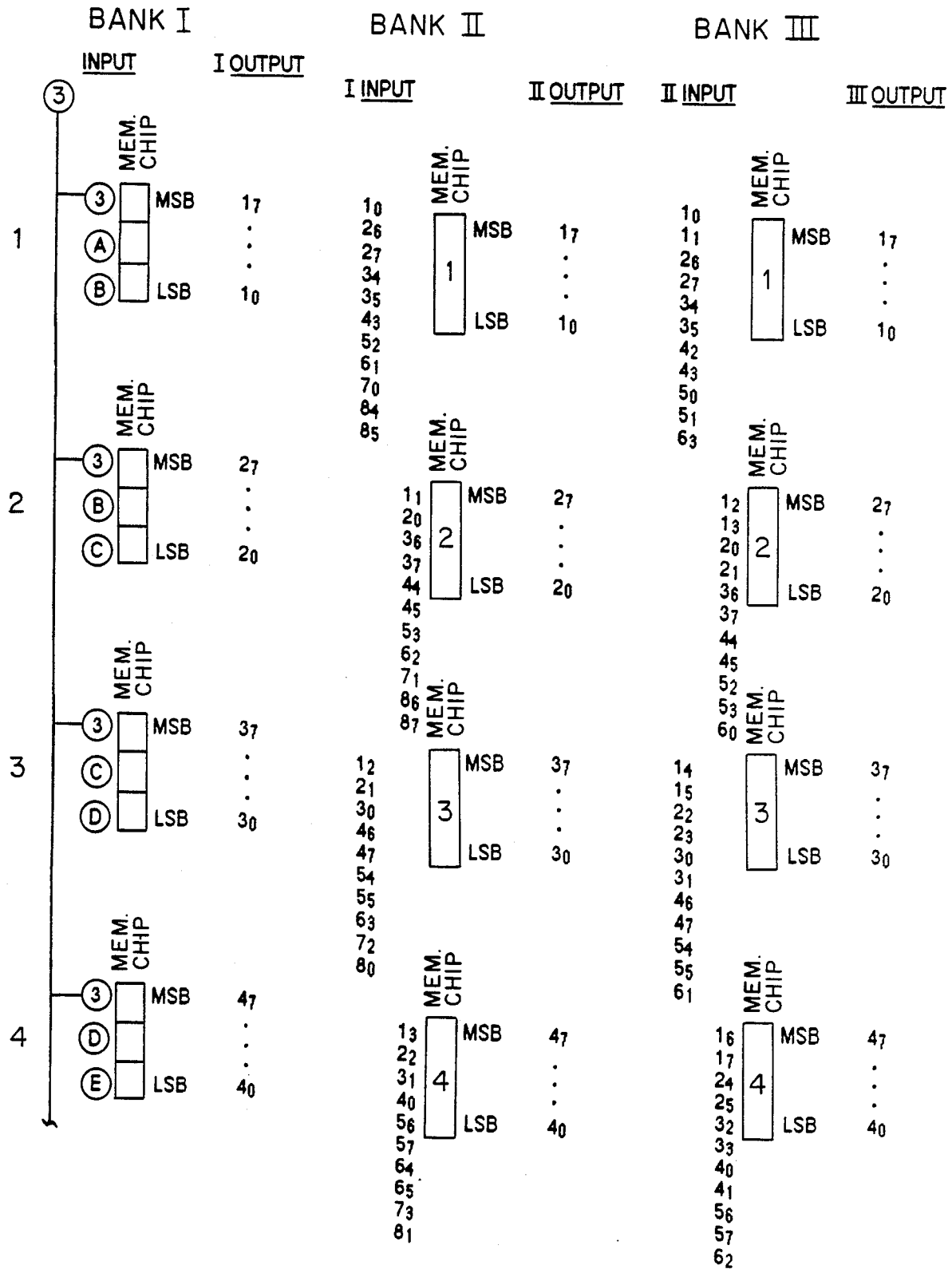
FIGS. 7A and 7B are detailed schematic diagrams of one preferred embodiment of the look-up table of the present invention.
Figure 7B:
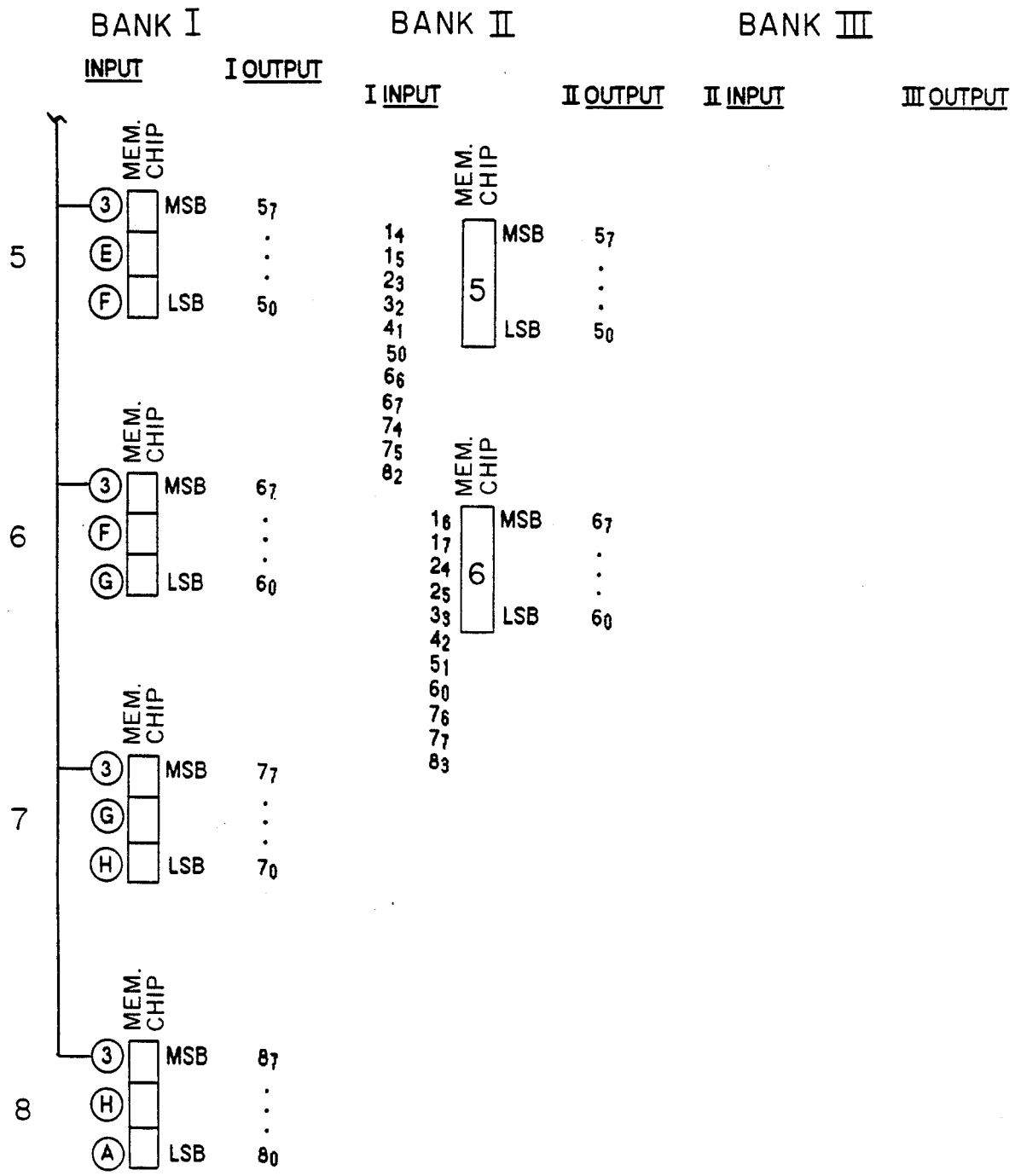

Referring to FIG. 7, there is shown in greater schematic detail of the look-up table 10 of the present invention, wherein 32 lines of input 20 are supplied to the look-up table 10. As described and shown in FIG. 5, the input lines 20 to the look-up table 10 are duplicated. In the embodiment shown in FIG. 7, all of the input lines 20 are duplicated. The input lines 20 and the duplicated input lines 20A are supplied to a first memory bank 22 As shown in FIG. 7 there are two groups of lines of A, B, C. . . H. The first memory bank 22 comprises 8 memory chips, with each memory chip containing 2k bytes of storage. Thus, 11 address input lines are supplied to each memory chip. The 8 memory chips of the first memory bank 22 are designated as 1, 2, 3 . . . 8. For memory chip 1 of the first memory bank 22, group B and group A of the input lines 20 and three other lines (which will be explained later) form the 11 lines of address input to the memory chip 1. For memory 2 of the first memory bank 22, group C and group B (group B being duplicated) and the three other lines form the 11 address input lines to memory chip 2. The three other lines supplied to memory chip 2 are the same three other lines supplied to memory chip 1 and are tied together. As shown in the diagram, LSB means least significant bit and MSB means most significant bit. The three other lines are connected in common to memory chips 1 through 8 and occupy the three most significant bits of each of the memory chips. The lower 8 address input lines of each memory chip are taken from the groups of input lines 20. For memory chip 3, the 8 bits are from groups C and D. For memory chip 4, the groups are D and E. For memory chip 5, the groups are E and F. For memory chip 6, the groups are F and G. For memory chip 7, the groups are G and H. For memory chip 8, the groups are H and A.

As previously stated, each memory chip has 2k bytes of storage with 8 lines of output. Each line of output is designated as the subscript to the chip number. Thus, the number $3_4$ means the 5th bit of the output of memory chip 3. (The subscript 4 indicates the fifth bit because the first bit is the subscript 0.)

The 64 lines of output (8 chips, each providing 8 lines of output from the first memory bank 22) are supplied to the second memory bank 26, along the first output lines 24.

The second memory bank 26 comprises 6 memory chips, each also having 2k bytes of storage. These are also designated sequentially as memory chips 1, 2, . . . 6. Again, since each memory chip has 2k bytes of storage, 11 address input lines are needed to address each memory chip. Since there are 64 lines of output from the first memory bank 22, supplying to 66 (6 chips, each with 11 lines of input) possible input lines, two of the memory chips in the second memory bank 26 will only have 10 lines of input. The 8 output lines of each memory chip of the first memory bank 22 are interconnected as the address input lines for all of the 6 memory chips of the second memory bank 26. Thus, for example, line $1_0$ is supplied on the input address line to memory chip 1 of the second memory bank 26. Line $1_1$ of the output of memory chip 1 of the first memory bank 22 is connected to the input address line of memory chip No. 2 of the second memory bank 26. Line $1_2$ is connected to memory chip 3. Line $1_3$ is connected to memory chip No. 4. Lines $1_4$ and $1_5$ are connected to memory chip No. 5. Lines $1_6$ and $1_7$ are connected to memory chip No. 6.

The specific interconnection of the output of each of the memory chips from the first memory bank 22 to the input address lines of the memory chips of the second memory bank 26 is as follows: Input address lines for memory chip No. 1 of the second memory bank 26 are $1_0\ 2_6\ 2_7\ 3_4\ 3_5\ 4_3\ 5_2\ 6_1\ 7_0\ 8_4\ 8_5$. The input address lines for memory chip No. 2 of the second memory bank 26 are $1_1\ 2_0\ 3_6\ 3_7\ 4_4\ 4_5\ 5_3\ 6_2\ 7_1\ 8_6\ 8_7$. For memory chip No. 3, the input lines are $1_2\ 2_1\ 3_0\ 4_6\ 4_7\ 5_4\ 5_5\ 6_3\ 7_2\ 8_0$. For memory chip No. 4, the input lines are $1_3\ 2_2\ 3_1\ 4_0\ 5_6\ 5_7\ 6_4\ 6_5\ 7_3\ 8_1$. For memory chip No. 5, the input lines are $1_4\ 1_5\ 2_3\ 3_2\ 4_1\ 5_0\ 6_6\ 6_7\ 7_4\ 7_5\ 8_2$. For memory chip No. 6, the input lines are $1_6\ 1_7\ 2_4\ 2_5\ 3_3\ 4_2\ 5_1\ 6_0\ 7_6\ 7_7\ 8_3$. Similar to the memory chips of the first memory bank 22, each of the memory chips of the second memory bank 26 has 8 lines of output. They are designated, using the same convention as was described for the memory chips of the first memory bank 22.

The output of the memory chips of the second memory bank are supplied along the second output line 28 as the address input to the third memory bank 30. The third memory bank 30 comprises four memory chips, each memory chip having 2k bytes of storage. Again, similar to the convention described previously, each of the output lines of each of the memory chips from the second memory bank 26 is supplied as an input address to the third memory bank 30. Thus, the address input lines for memory chip No. 1 of the third memory bank 30 are $1_0\ 1_1\ 2_6\ 2_7\ 3_4\ 3_5\ 4_2\ 4_3\ 5_0\ 5_1\ 6_3$. The address input lines for memory chip No. 2 of the third memory bank 30 are $1_2\ 1_3\ 2_0\ 2_1\ 3_6\ 3_7\ 4_4\ 4_5\ 5_2\ 5_3\ 6_0$. The address input lines for memory chip No. 3 are $1_4\ 1_5\ 2_2\ 2_3\ 3_0\ 3_1\ 4_6\ 4_7\ 5_4\ 5_5\ 6_1$. The address input lines for memory chip No. 4 are $1_6\ 1_7\ 2_4\ 2_5\ 3_2\ 3_3\ 4_0\ 4_1\ 5_6\ 5_7\ 6_2$.

Each of the four memory chips of the third memory bank 30 has 8 lines of output. Thus, the total output of the third memory bank 30 is 32 lines which are then supplied along the output lines 32 to the D-to-A converter 14.

As previously stated, three input lines are connected to each of the memory chips of the first memory bank 22. The three lines are connected to all the memory chips. There are thus 8 possible combinations. The 8 possible combinations form 8 complete sets for the look-up 10 for 32 bits. Each of the sets can change the display on the color display 16.

As can be seen from FIG. 7, a full look-up table 10 of the present invention for 32 bits requires the use of only 18 2k byte RAM chips.

The theory of operation of the present invention is as follows. For a large number of input lines (such as 32), the 32 input lines are divided into a plurality of small tables. The adjacent input bits are duplicated because adjacent bits are most likely to have similar meaning. Further, the outputs of the first memory bank 22 are mixed and provided as inputs to the second memory bank 26 to ensure that a single input to the first memory bank 22 can effect all of the second memory bank 26.

It should be recognized that one of the important features of the look-up table 10 of the present invention is that the input data path received by the look-up table 10 is initially and temporarily increased. Thus, the input data lines 20 are duplicated. While one embodiment has been described in which all of the input data lines 20 are duplicated, it is believed that the duplication of all of the input data lines is not necessary. Although the duplication of all of the input data lines 20 has resulted in a full look-up table for 32 bits, it is believed that the invention can be practiced equally well in which only some of the input data lines 20 are duplicated.

Although the invention is not as flexible as the Table of Random Entries look-up table (no device can perform the theoretical limits of a Table of Random Entries), the look-up table 10 of the present invention can perform functions such as change color, implement large number of overlay planes, and intelligent allocation of bit planes to windows.

I claim:

1. A look-up table for interfacing between a plurality of address lines output from a memory frame buffer and a plurality of data lines input to a color monitor in a digital, color graphics display apparatus, said table comprising:

means for duplicating some of said address lines of said memory frame buffer;

first addressable memory means for receiving said address lines and said duplicated address lines and for generating a first output signal from the location addressed, wherein the number of data lines containing said first output signal is less than the address and duplicated address lines to said first memory means;

second addressable memory means for receiving said first output signal as an address therefor and for generating a second output signal from the location addressed, wherein the number of data lines containing said second output signal is less than the address lines to said second memory means; and third addressable memory means for receiving said second output signal as an address therefor and for generating a third output signal from the location addressed and for supplying said third output signal to said color monitor, and wherein the number of data lines containing said third output signal is less than the address lines to said third memory means.

2. The look-up table of claim 1 wherein said duplicating means duplicates all of said output of said memory frame buffer.

3. The look-up table of claim 1 wherein said first memory means comprises a plurality of second memories.

4. The look-up table of claim 3 wherein said second memory means comprises a plurality of second memories.

5. The look-up table of claim 4 wherein said third memory means comprises a plurality of third memories.

6. A look-up table for receiving a plurality of groups of input address lines, and for generating a plurality of output data lines therefrom, said look-up table comprising:

means for duplicating some of the groups of input address lines;

a first memory bank means including a plurality of directly addressable first memories, each first memory having a plurality of first input address lines and a plurality of first output data lines wherein the number of first output data lines is less than said first input address lines;

first connecting means for interconnecting said plurality of groups of input address lines and said duplicated groups of input address lines to the first input address of said first memories;

a second memory bank means including a plurality of directly addressable second memories, each second memory having a plurality of second input address lines and a plurality of second output data lines wherein the number of second output data lines is less than said second input address lines;

second connecting means for interconnecting the first output data lines to the second input address lines;

a third memory bank means including a plurality of directly addressable third memories, each third memory having a plurality of third input address lines and a plurality of third output data lines is less than said third input address lines; and third connecting means for interconnecting the second output data lines to the third input address lines;

whereby said third output data lines is said output of said look-up table.

7. The look-up table of claim 6 wherein said duplicating means duplicates all of the groups of input lines.

8. The look-up table of claim 7 wherein said first connecting means comprises:

means for interconnecting one of said group of input lines and another group of duplicated input lines to the first input address of each first memories.

9. The look-up table of claim 6 wherein said second connecting means comprises:

means for interconnecting one of the first output lines of each first memory to one of the second input address of each second memory.

10. The look-up table of claim 6 wherein said third connecting means comprises:

means for interconnecting one of the second output lines of each second memory to one of the second input address of each third memory.

* * * * *